US010077513B1

(12) United States Patent
Wood

(10) Patent No.: US 10,077,513 B1
(45) Date of Patent: Sep. 18, 2018

(54) STITCH MARKER

(71) Applicant: Genevieve Eleanor Wood, Berea, OH (US)

(72) Inventor: Genevieve Eleanor Wood, Berea, OH (US)

( * ) Notice: Subject to any disclaimer, the term of this patent is extended or adjusted under 35 U.S.C. 154(b) by 56 days.

(21) Appl. No.: 15/460,384

(22) Filed: Mar. 16, 2017

(51) Int. Cl.
*D04B 3/00* (2006.01)

(52) U.S. Cl.
CPC ..... *D04B 3/00* (2013.01)

(58) Field of Classification Search
CPC ... D04B 3/00; D04B 3/02; D04B 3/04; D04B 3/06
USPC ..... 66/1 R, 1 A
See application file for complete search history.

(56) References Cited

U.S. PATENT DOCUMENTS 2,118,210 A * 5/1938 Luther ..... D04B 3/00 235/123
2,274,181 A * 2/1942 Ariani ..... D04B 3/00 116/320
2,558,974 A * 7/1951 Mecklenburger ..... D04B 3/00 33/733
2,582,319 A * 1/1952 Ellis, Jr. ..... D04B 3/00 235/124
3,438,223 A * 4/1969 Linstead ..... D04B 3/00 66/1 A
4,172,521 A * 10/1979 Eubanks ..... D05C 1/065 206/388
5,537,844 A * 7/1996 MacLean ..... D04B 3/00 24/662
8,813,524 B2 * 8/2014 Thompson ..... D04B 3/00 66/1 A
9,149,096 B2 * 10/2015 Ng ..... A44C 5/0069
2014/0144189 A1 * 5/2014 Thompson ..... D04B 3/00 66/1 A
2014/0318189 A1 * 10/2014 Oe ..... D04B 3/00 66/1 A

* cited by examiner

*Primary Examiner* — Danny Worrell
(74) *Attorney, Agent, or Firm* — Dunlap Bennett & Ludwig PLLC

(57) ABSTRACT

A stitch marker is provided. The stitch marker includes a first ring including a first identifier and a second ring including a second identifier different from the first identifier. The first ring and the second ring may be connected together by a looped wire. The looped wire allows the first ring and the second ring to pivot relative to one another.

10 Claims, 2 Drawing Sheets

STITCH MARKER

BACKGROUND OF THE INVENTION

The present invention relates to knitting and, more particularly, to a stitch marker used during knitting.

Knitting is a method by which yarn is manipulated to create a textile or fabric. Knitting creates multiple loops of yarn, called stitches, in a line or tube. Knitting has multiple active stitches on the needle at one time. Knitted fabric consists of a number of consecutive rows of interlocking loops. As each row progresses, a newly created loop is pulled through one or more loops from the prior row, placed on the gaining needle, and the loops from the prior row are then pulled off the other needle.

For large or complex knitting patterns, it is sometimes difficult to keep track of which stitch should be knit in a particular way; therefore, several tools have been developed to identify the number of a particular row or stitch, including circular stitch markers, hanging markers, extra yarn and row counters. Many knitting patterns involve a task that is done only on the front and not the back or only on row one and not two. Keeping track of this variable requires multiple stitch markers that can easily be misplaced or forgotten.

As can be seen, there is a need for an improved stitch marker that identifies two different types of stitch rows.

SUMMARY OF THE INVENTION

In one aspect of the present invention, a method of using a stitch marker comprises the steps of: providing the stitch marker comprising a first ring comprising a first identifier and a second ring comprising a second identifier different from the first identifier, wherein the first ring and the second ring are secured together; providing a first needle, a second needle and yarn to knit a plurality of rows of stitches; knitting a first row from the second needle to the first needle; placing the first ring over the first needle while knitting the first row to indicate a first stitch type; knitting a remainder of the first row from the second needle to the first needle using the first stitch type; knitting a second row from the first needle to the second needle using the first stitch type until the first ring is revealed and removeable from the first needle; and placing the second ring over the second needle.

In another aspect of the present invention, a method of using a stitch marker comprising the steps of: providing the stitch marker comprising a first ring comprising a first identifier, wherein the first identifier comprises a first color and a first textured surface, and a second ring comprising a second identifier different from the first identifier, wherein the second identifier comprises a second color and a second textured surface, wherein the first ring and the second ring are secured together; providing a first needle, a second needle and yarn to knit a plurality of rows of stitches; knitting a first row from the second needle to the first needle; placing the first ring over the first needle while knitting the first row to indicate a first stitch type; knitting a remainder of the first row from the second needle to the first needle using the first stitch type; knitting a second row from the first needle to the second needle using the first stitch type until the first ring is revealed and removeable from the first needle; and placing the second ring over the second needle.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a stitch marker to indicate a type of stitch while knitting. The present invention may further indicate a right or wrong side or indicate the difference from a first and second row. Many knitting patterns involve a task that is done only on the front and not the back or only on row one and not the other. The stitch marker of the present invention places the answer on the knit garment itself, removing the need for a separate method of recording the information. The stitch marker of the present invention works as a classic stitch marker, an essential knitting tool, and offers a Boolean variable counter directly on the needle, removing the need for a separate method of keeping track.

The present invention includes two rings connected together by a wire. The rings may be endless loops made of a plastic, metal material or other semi-solid to solid material. The two rings each work as a marker, signaling a place in the project where there is a task to be done. Switching from one ring to another allows the present invention to signal the change of instructions in a simple manner. The present invention creates a marker that is different in both vision and texture between rows one and two.

Knitted fabric includes of a number of consecutive rows of interlocking loops. As each row progresses, a newly created loop is pulled through one or more loops from the prior row, placed on the gaining needle, and the loops from the prior row are then pulled off the other needle.

Figure 1:
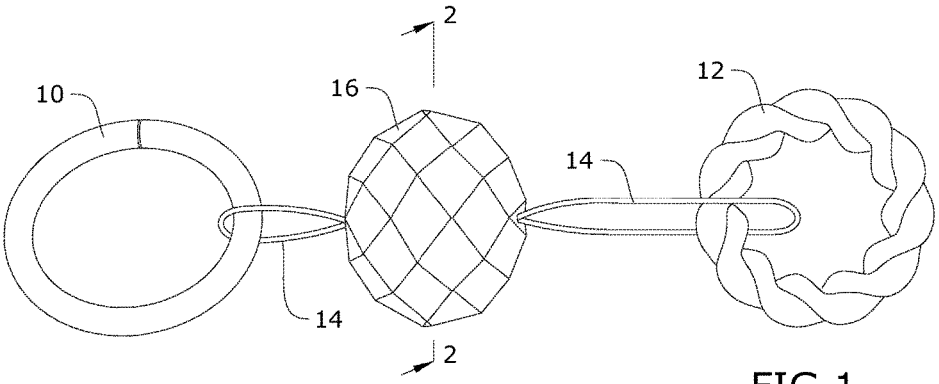
FIG. 1 is a perspective view of an embodiment of the present invention.
Figure 2:
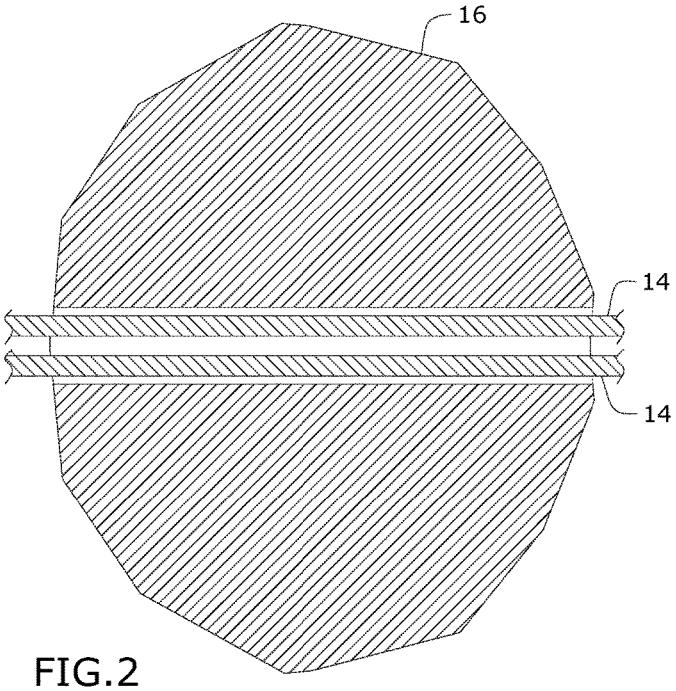
FIG. 2 is a section detail view taken along line 2-2 in FIG. 1.

Referring to FIGS. 1 and 2, the present invention includes a stitch marker. The stitch marker includes a first ring 10 including a first identifier and a second ring 12 including a second identifier that is different from the first identifier. The first ring 10 and the second ring 12 may be connected together by a looped wire 14. The looped wire 14 allows the first ring 10 and the second ring 12 to pivot relative to one another. In certain embodiments, the present invention includes a bead 16. The bead 16 includes a channel running through a center portion. The looped wire 14 may run through the channel of the bead 16. The bead 16 is thereby disposed in between the first ring 10 and the second ring 12.

The first ring 10 and the second ring 12 each include a different identifier to quickly distinguish a type of stitch that is knit within a row. In certain embodiments, the first identifier is a first color and the second identifier is a second color. For those that have trouble seeing or those that are color blind, the first identifier is a first texture and the second identifier is a second texture. For example, the first ring 10 may include a smooth surface and the second ring 12 may include a textured surface. As illustrated in the Figures, the second ring 12 may include a twisted ring. The different textures allow users to touch the first and second rings 10, 12 to determine what type of stitch is performed for the row.

Figure 3:
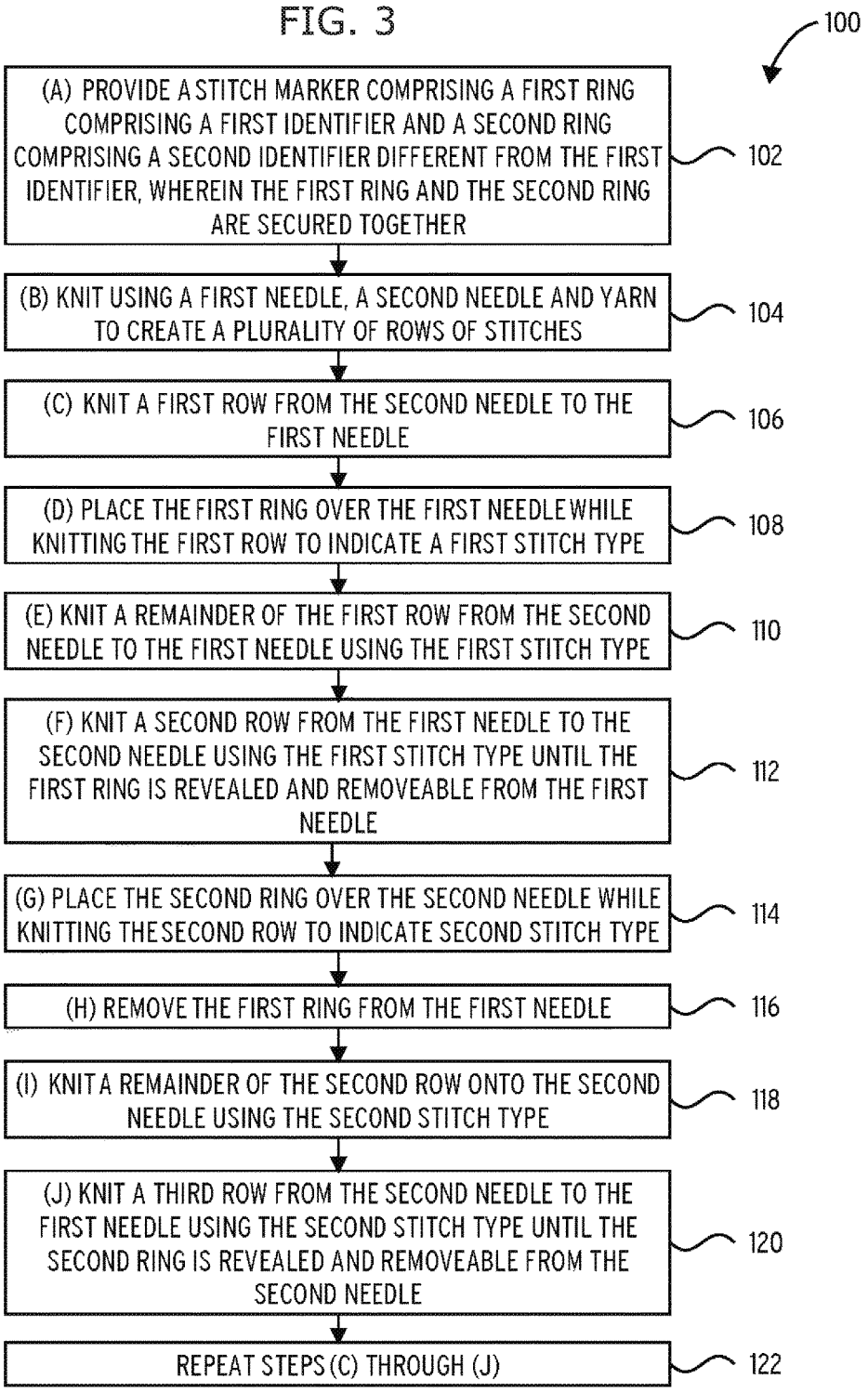
FIG. 3 is a flow chart of a method of using the present invention.

Referring to FIG. 3, the present invention may further include a method of using the stitch marker 100. The steps may include the following: provide the stitch marker mentioned above 102; provide a first needle, a second needle and yarn to knit a plurality of rows of stitches 104; knit a first row from the second needle to the first needle 106; place the first ring over the first needle while knitting the first row to indicate a first stitch type 108; knit a remainder of the first row from the second needle to the first needle using the first stitch type 110; knit a second row from the first needle to the second needle using the first stitch type until the first ring is revealed and removeable from the first needle 112; place the second ring over the second needle 114; remove the first ring from the first needle 116; knit a remainder of the second row onto the second needle using the second stitch type 118; knit a third row from the second needle to the first needle using the second stitch type until the second ring is revealed and removeable from the second needle 120; and repeat steps 106 through 120.

It should be understood, of course, that the foregoing relates to exemplary embodiments of the invention and that modifications may be made without departing from the spirit and scope of the invention as set forth in the following claims.

What is claimed is:

1. A method of using a stitch marker comprising the steps of:

(a) providing the stitch marker comprising a first ring comprising a first identifier and a second ring comprising a second identifier different from the first identifier, wherein the first ring and the second ring are secured together;

(b) providing a first needle, a second needle and yarn to knit a plurality of rows of stitches;

(c) knitting a first row from the second needle to the first needle;

(d) placing the first ring over the first needle while knitting the first row to indicate a first stitch type;

(e) knitting a remainder of the first row from the second needle to the first needle using the first stitch type;

(f) knitting a second row from the first needle to the second needle using the first stitch type until the first ring is revealed and removeable from the first needle; and (g) placing the second ring over the second needle.

2. The method of claim 1, further comprising the steps of:

(h) removing the first ring from the first needle;

(i) knitting a remainder of the second row onto the second needle using the second stitch type; and (j) knitting a third row from the second needle to the first needle using the second stitch type until the second ring is revealed and removeable from the second needle.

3. The method of claim 2, further comprising repeating steps (c) through (j).

4. The method of claim 1, wherein the first identifier is a first color and the second identifier is a second color.

5. The method of claim 1, wherein the first identifier is a first textured surface and the second identifier is a second textured surface.

6. The method of claim 1, further comprising a wire connecting the first ring and the second ring together.

7. The method of claim 6, further comprising a bead comprising a channel, wherein the wire is disposed within the channel and the bead is disposed in between the first ring and the second ring.

8. A method of using a stitch marker comprising the steps of:

(a) providing the stitch marker comprising a first ring comprising a first identifier, wherein the first identifier comprises a first color and a first textured surface, and a second ring comprising a second identifier different from the first identifier, wherein the second identifier comprises a second color and a second textured surface, wherein the first ring and the second ring are secured together;

(b) providing a first needle, a second needle and yarn to knit a plurality of rows of stitches;

(c) knitting a first row from the second needle to the first needle;

(d) placing the first ring over the first needle while knitting the first row to indicate a first stitch type;

(e) knitting a remainder of the first row from the second needle to the first needle using the first stitch type;

(f) knitting a second row from the first needle to the second needle using the first stitch type until the first ring is revealed and removeable from the first needle; and (g) placing the second ring over the second needle.

9. The method of claim 8, further comprising the steps of:

(h) removing the first ring from the first needle;

(i) knitting a remainder of the second row onto the second needle using the second stitch type; and (j) knitting a third row from the second needle to the first needle using the second stitch type until the second ring is revealed and removeable from the second needle.

10. The method of claim 9, further comprising repeating steps (c) through (j).

* * * * *